US007350380B2

(12) United States Patent
Kim et al.

(10) Patent No.: US 7,350,380 B2
(45) Date of Patent: Apr. 1, 2008

(54) WASHING MACHINE

(75) Inventors: Jong Seok Kim, Changwon-si (KR); Yang Hwan No, Changwon-si (KR); Han Ki Cho, Changwon-si (KR); Yeon Su Jung, Changwon-si (KR); Jung Hoon Kang, Changwon-si (KR); Myung Sik Park, Changwon-si (KR); Young Hoon Ha, Masan-si (KR)

(73) Assignee: LG Electronics Inc., Seoul (KR)

( * ) Notice: Subject to any disclaimer, the term of this patent is extended or adjusted under 35 U.S.C. 154(b) by 614 days.

(21) Appl. No.: 10/720,541

(22) Filed: Nov. 25, 2003

(65) Prior Publication Data

US 2004/0163422 A1 Aug. 26, 2004

(30) Foreign Application Priority Data

Nov. 28, 2002 (KR) ..... 10-2002-0075013

(51) Int. Cl.
*D06F 33/00* (2006.01)

(52) U.S. Cl. ..... 68/12.05; 68/12.21; 68/12.27

(58) Field of Classification Search ..... 68/12.05, 68/12.21, 12.27
See application file for complete search history.

(56) References Cited

U.S. PATENT DOCUMENTS 2,223,509 A * 12/1940 Brauer ..... 137/67
2,985,966 A * 5/1961 Martin ..... 34/75
3,691,797 A * 9/1972 Smith ..... 68/23.4
4,821,537 A * 4/1989 Zinkann et al. ..... 68/208
5,797,426 A * 8/1998 Powell ..... 137/533.11

* cited by examiner

*Primary Examiner*—Michael Barr
*Assistant Examiner*—Jason Heckert
(74) *Attorney, Agent, or Firm*—Birch, Stewart, Kolasch & Birch, LLP

(57) ABSTRACT

Disclosed is a washing machine enabling to prevent foam from leaking. The present invention includes a housing, a tub installed in the housing to store water, the tub having at least one opening and at least one pipe connected to the at least one opening, a drum rotatably installed in the tub to hold a laundry therein for washing, and a valve assembly installed at the opening to selectively cut off the at least one pipe to prevent foam produced in the drum and the tub from leaking outside via the opening.

29 Claims, 10 Drawing Sheets

WASHING MACHINE

This application claims the benefit of Korean Application(s) No. 10-2002-0075013 filed on Nov. 28, 2002, which is/are hereby incorporated by reference.

BACKGROUND OF THE INVENTION

1. Field of the Invention

The present invention relates to a washing machine enabling to prevent foam generated inside from leaking outside.

2. Discussion of the Related Art

Generally, a washing machine includes a drum installed inside and rotates the drum to wash a laundry inside. A tub having the drum inside is installed in the washing machine to preliminary store water to supply to the drum. The tub is connected to a water supply pipe. The water supply pipe communicates with a detergent box to supply the tub with the detergent as well as the water.

Yet, the foam generated by the detergent during washing follows the water supply valve to flow in the detergent box, thereby contaminating the detergent box. Furthermore, the foam may leak outside via the detergent box so as to contaminate the washing machine and its surroundings.

Specifically, compared to a top loading type washing machine of which drum and tub stand upright, a front loading type washing machine of which drum and tub lie horizontally generates more foam to increase the probability of leakage. Hence, a special detergent producing less foam is used for the front loading type washing machine. Yet, such a special detergent fails to exclude the possibility of the foam leakage.

SUMMARY OF THE INVENTION

Accordingly, the present invention is directed to a washing machine that substantially obviates one or more of the problems due to limitations and disadvantages of the related art.

An object of the present invention, which has been devised to solve the foregoing problem, lies in providing a washing machine, by which foam produced in a drum and a tub is prevented from leaking.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine including a washing machine including a housing, a tub installed in the housing to store water, the tub having at least one opening and at least one pipe connected to the at least one opening, a drum rotatably installed in the tub to hold a laundry therein for washing, and a valve assembly installed at the opening to selectively cut off the at least one pipe to prevent foam produced in the drum and the tub from leaking outside via the opening.

The at least one opening and the at least one pipe are an inlet opening for supplying the water to the tub from an external water supply source and an inlet pipe connected to the inlet opening, respectively or a ventilation opening for allowing an external air to flow in the tub and a ventilation pipe connected to the ventilation opening, respectively.

The valve assembly comprises a valve installed in the opening to float on the foam and a guide formed in the opening to guide a movement of the valve.

Preferably, the valve assembly is formed at the opening to be installed in an extension pipe connected to the at least one pipe. Moreover, the valve is smaller than the opening and is greater than a diameter of the pipe.

Preferably, the pipe has a pipe diameter partially reduced in the vicinity of the opening to be stably cut off by the valve assembly. More preferably, the pipe comprises a rib extending inward from an inner circumference or is a corrugated or bellows pipe having a multitude of folds.

The valve comprises a floating body having a concave surface and a shaft part extending from a bottom of the floating body to be guided by the guide. The floating body is a semi-spherical shell and preferably further includes a flange horizontally extending from an edge. Preferably, the shaft part is a hollow shaft. More preferably, an outer circumference of the shaft part is covered with a second elastic member.

Moreover, the guide includes a hub holding the shaft part movably to support the bottom of the floating body and a plurality of ribs extending between an outer circumference of the hub and an inner circumference of the opening. Each of the ribs is uniform in height in the vicinity of the inner circumference of the opening but gradually increases in height in the vicinity of the outer circumference of the hub.

Preferably, the valve further comprises a first elastic member provided on an outer circumference of the shaft part to lie between the guide and the floating body. More preferably, a buffer protrusion is formed at a lower end of the first elastic member.

Moreover, an inside diameter of the hub gradually increases preferably. More preferably, the inside diameter of the hub gradually increases toward a top. An outside diameter of the shaft part gradually increases to be brought contact with an inside diameter of the hub. Preferably, the outside diameter of the shaft part gradually increases toward a top.

Meanwhile, the valve assembly preferably further includes a plate member installed under the valve to cut off the opening partially. In this case, the plate member is a disc type. And, a size of the plate member is equal to or greater than a cross-section of a lower end of the valve. Specifically, the plate member includes at least one leg extending vertically from a bottom and a hook provided at a tip of the leg to be caught on a portion of the guide.

Therefore, the washing machine according to the present invention prevents the foam from being discharged outside the washing machine, thereby enabling the washing machine to avoid the contamination of the foam.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
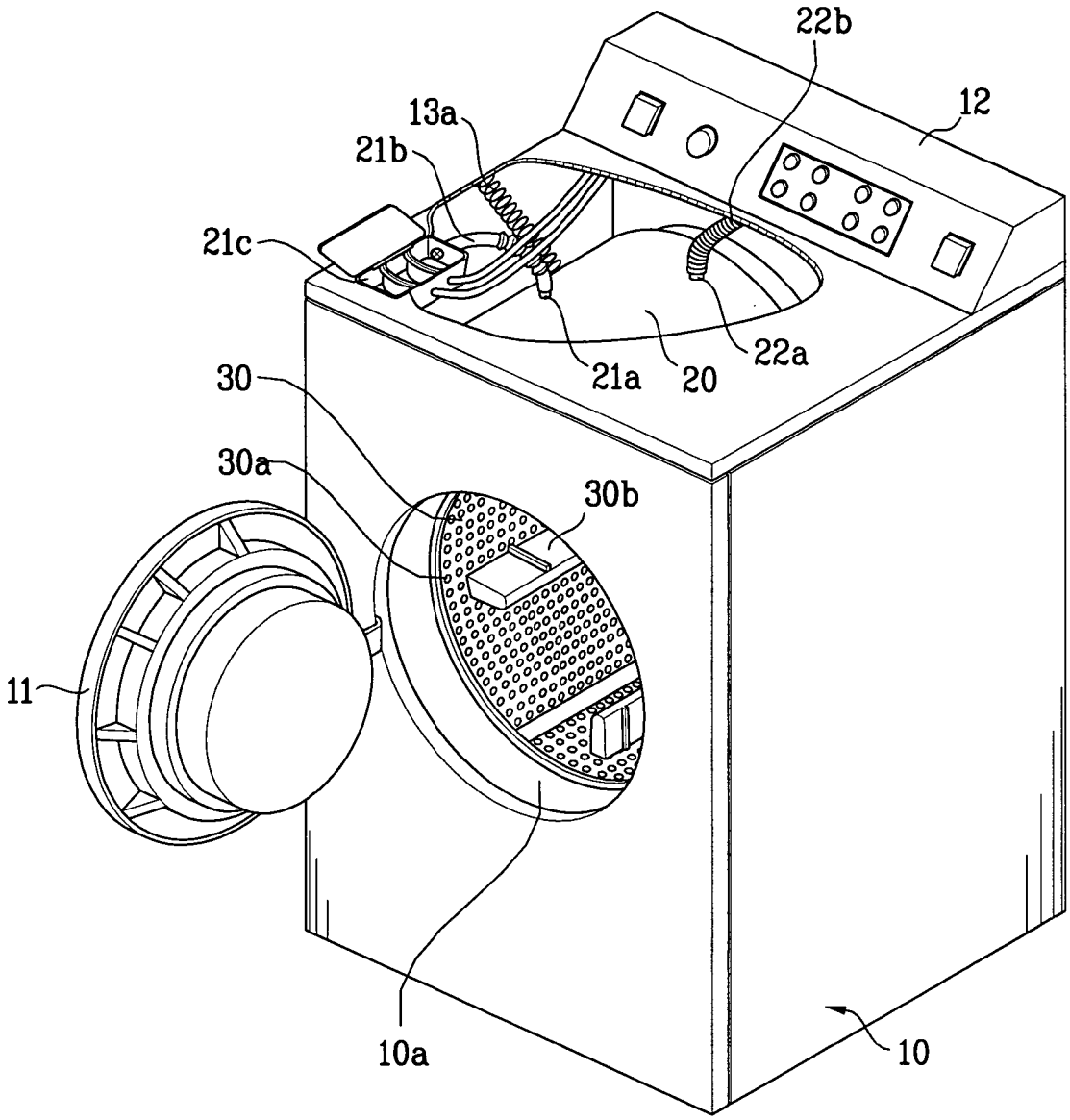
FIG. 1 is a perspective view of a washing machine according to the present invention.
Figure 2:
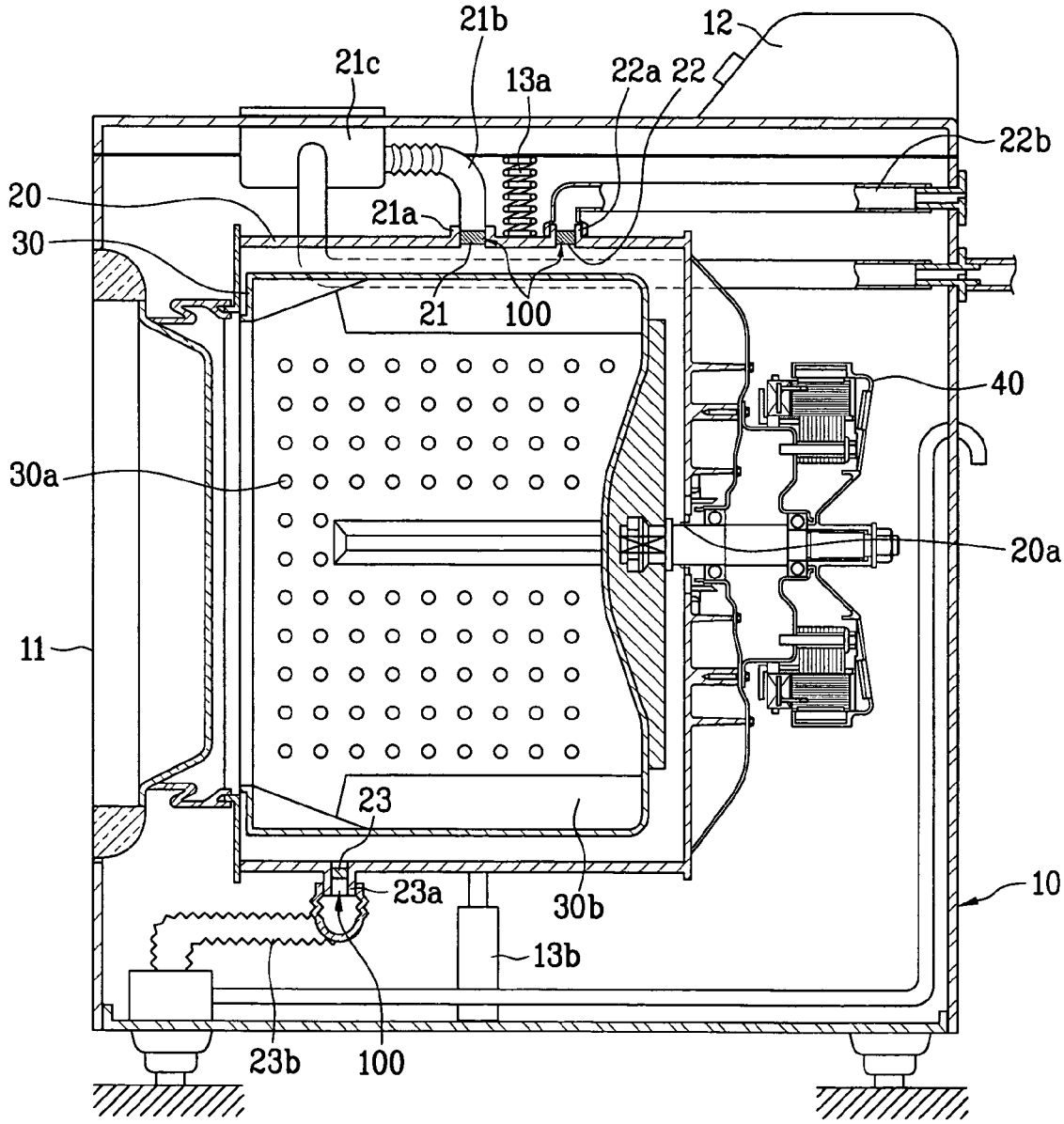
FIG. 2 is a cross-sectional view of a washing machine according to the present invention.

FIG. 1 is a perspective view of a washing machine according to the present invention and FIG. 2 is a cross-sectional view of a washing machine according to the present invention. The washing machine shown in FIG. 1 and FIG. 2 adopts a front loading type but is as good as a top loading type washing machine except that a tub 20 and a drum 30 are horizontally installed. For convenience of explanation, the present invention is described for the front loading type washing machine but is applicable to the top loading type washing machine the same manner.

Referring to FIG. 1 and FIG. 2, a washing machine according to the present invention basically includes a housing 10, a tub 20 installed in the housing 10, and a drum 30 in the tub 20.

The housing 10 is designed to hold various parts of the washing machine inside to protect. A door 11 is installed at a front side of the housing 10 to open/close an entrance 10*a* communicating with the drum 10, and a control panel 12 is installed on the housing 10. A user uses the control panel 12 to direct an operation of the washing machine and loads a laundry a laundry in/from the drum 30 via the door 11.

The tub 20 preliminary holds water to supply the water to the drum 30 uniformly. The tub 20 is elastically installed in the housing 10 using dampers 13*a* and 13*b*. A penetration hole 20*a* is formed at a bottom center of the tub 20, and a driving shaft is installed through the penetration hole 20*a* to be connected to the drum 30. Moreover, the tub 20 includes a plurality of openings 21, 22, and 23 and a plurality of pipes 21*b*, 22*b*, and 23*b* connected to the openings 21, 22, and 23, respectively. The openings 21, 22, and 23 have extension pipes 21*a*, 22*a*, and 23*a* to which the pipes 21*b*, 22*b*, and 23*b* can be more securely connected, respectively. The tub 30 can be connected to various external equipments necessary for operation using the openings 21, 22, and 23 and the pipes 21*b*, 22*b*, and 23*b*. Specifically, the tub 20 includes an inlet opening 21 for having water flow in and an inlet pipe 21*b* connected to the inlet opening 21. The inlet pipe 21*b* is connected between the inlet opening 21 and a detergent box 21*c* and extends again to an external water supply source from the detergent box 21*c* via the housing 10. The water is supplied to the tub 20 together with the detergent from the water supply source via the inlet pipe 21*b*, detergent box 21*c*, and inlet opening 21. Moreover, an outlet opening 23 is formed at the tub 20. And, an outlet pipe 23*b* is connected to the outlet opening 23. The outlet pipe 23*b* extends to an external drain equipment, and the used water is discharged via the outlet opening 23 and the outlet pipe 23*b*.

Meanwhile, a size of the drum 30 of a large-capacity washing machine is so big that a child may enter the drum 30. For such a safety reason, a ventilation opening 22 is formed at the tub 30 so that the child can breathe even if the door 11 is closed. And, a ventilation pipe 22*b* is connected to the ventilation opening 22 to communicate with an atmosphere outside the washing machine. Hence, external air is supplied to the tub 20 via the ventilation pipe 22*b* and the ventilation pipe 22 to prevent the child from being suffocated.

The drum 30 holds a laundry therein and is rotatably installed in the tub 20. And, the drum 30 includes a multitude of perforated holes 30*a* enabling water to flow from the tub 20. Moreover, a plurality of baffles 30*b* are attached to an inner circumference of the drum 30 to mix the laundry well. The driving unit 40 is installed in the vicinity of the tub 20 to provide a dynamic force for a rotation of the drum 30. Specifically, the driving unit 40 includes a motor, a clutch, and the like and is connected to the drum 30 to drive through a driving shaft.

While the above-constructed washing machine operates, foam is produced as the rotation of the drum 30 mixes the water with the detergent. And, the foam may leak outside the washing machine via the openings 21, 22, and 23 and the pipes 21*b*, 22*b*, and 23*b*. For instance, the foam passes the inlet opening 21 and the inlet pipe 21*b* to leak outside the washing machine via the detergent box 21*c*. And, the ventilation opening 22 and the ventilation pipe 22*b*, as shown in the drawing, directly communicate with the external atmosphere, whereby the foam easily leaks through the housing 10. For such a reason, the washing machine according to the present invention includes a cut-off means for preventing the foam from leaking outside the washing machine. On the other hand, the outlet opening 23 and the outlet pipe 23*b* fail to communicate with the external atmosphere but discharge the water periodically. There is less possibility of foam leakage via the outlet opening 23 and the outlet pipe 23*b*. Hence, the cut-off means is mainly applied to the inlet opening 21 and the ventilation opening 22. Yet, such an embodiment is applicable to the outlet pipe 23 without modification as well.

First of all, since the foam substantially starts to leak from the openings, i.e., inlet opening 21, ventilation opening 22, and outlet opening 23, it is very effective to cut off the foam from the openings. Hence, a valve assembly 100 as a cut-of means is installed at each of the openings 21, 22, and 23. The valve assembly 100 is constructed to effectively cut off each of the pipes 21*b*, 22*b*, and 23*b* connected to the corresponding openings, respectively. Such a valve assembly 100 is explained by various embodiments of the present invention as follows.

Figure 3:
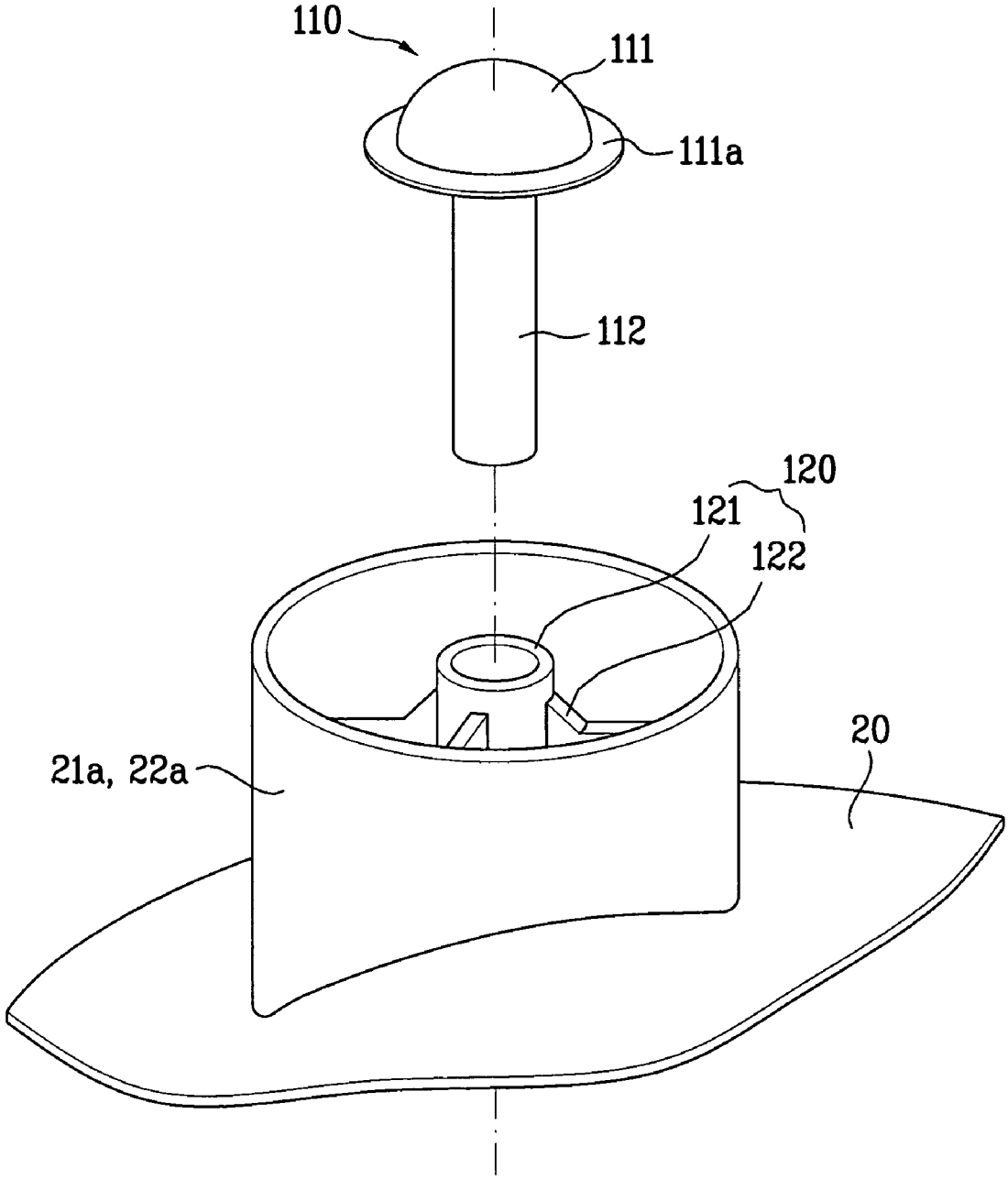
FIG. 3 is a perspective view of a valve assembly of a washing machine according to the present invention.
Figure 4A:
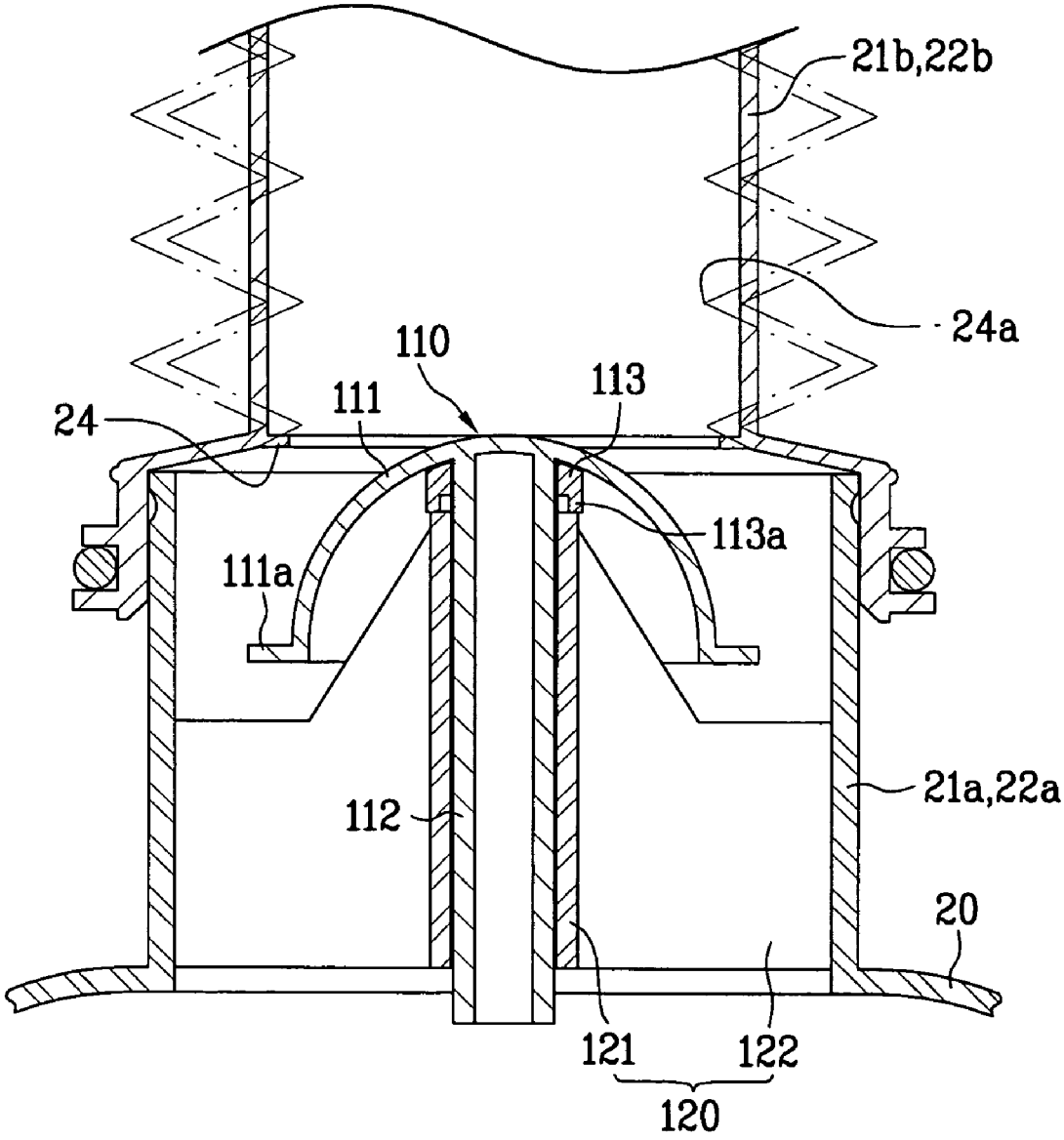
FIG. 4A and FIG. 4B are cross-sectional views of a valve assembly of a washing machine according to the present invention.
Figure 4B:
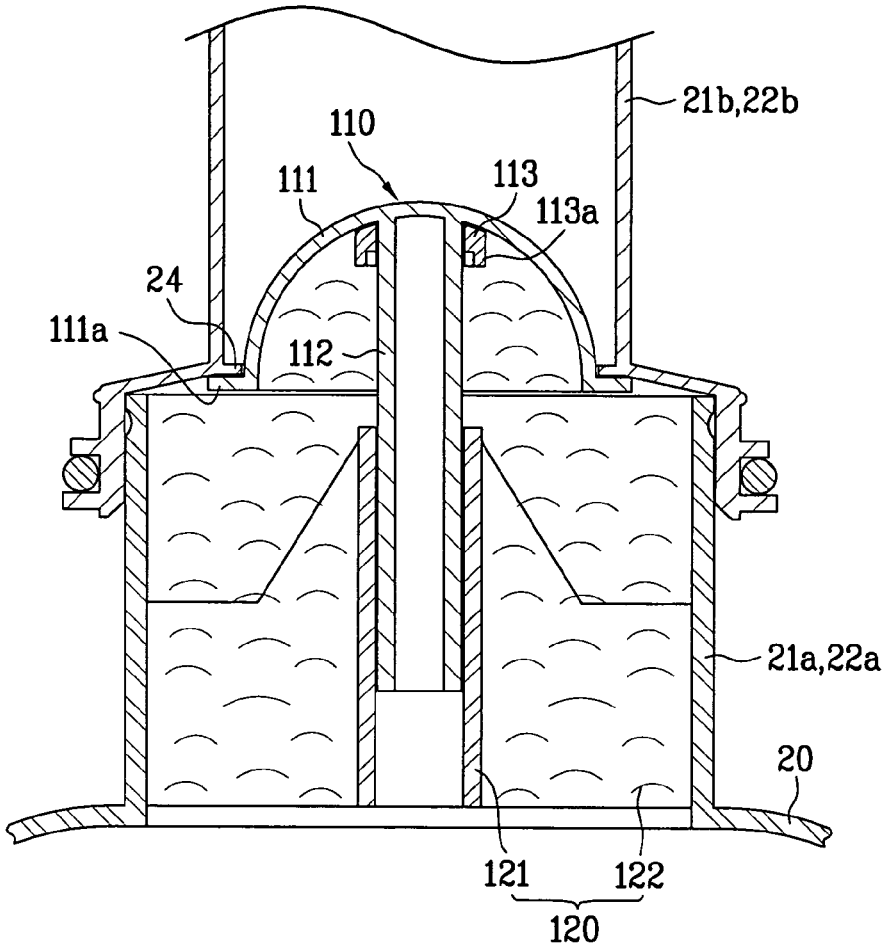
Figure 5:
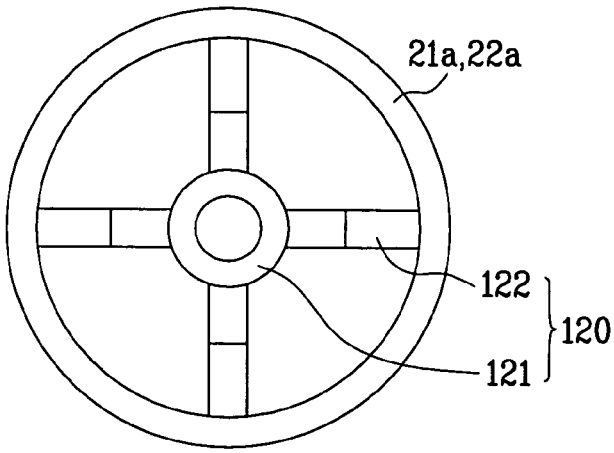
FIG. 5 is a layout of the valve assembly in FIG. 4A and FIG. 4B.

FIG. 3 is a perspective view of a valve assembly of a washing machine according to the present invention, FIG. 4A and FIG. 4B are cross-sectional views of a valve assembly of a washing machine according to the present invention, and FIG. 5 is a layout of the valve assembly in FIG. 4A and FIG. 4B.

FIG. 1 is a perspective view of a washing machine according to the present invention and FIG. 2 is a cross-sectional view of a washing machine according to the present invention. The washing machine shown in FIG. 1 and FIG. 2 adopts a front loading type but is as good as a top loading type washing machine except that a tub 20 and a drum 30 are horizontally installed. For convenience of explanation, the present invention is described for the front loading type washing machine but is applicable to the top loading type washing machine the same manner.

The valve assembly 100, as shown in the drawings, includes a valve 110 installed at the inlet or ventilation opening 21 or 22 (hereinafter called opening) and a guide installed in the opening 21 or 22. The valve assembly 100 can be directly installed on an inner circumference of the opening 21 or 22. Preferably, the valve assembly 100 is installed in an extension pipe 21*a* or 22*a* formed at the opening 21 or 22. In such a valve assembly 100, the valve 110 is installed movable upward and downward in the opening 21 or 22, and the guide 120 is installed to guide the movement of the valve 110. The valve 110 should be smaller than the opening, and more specifically, than the extension pipe 21*a* or 22*a* so as to enable the water and air to flow via the opening 21 or 22 as well as so as to move smoothly. Moreover, the valve 110 is formed greater than a diameter of the corresponding pipe to cut off the inlet or ventilation pipe 21*b* or 22*b* (hereinafter called pipe). In other words, the diameter of the pipe 21*b* or 22*b* can be designed to be smaller than a size of the valve 110 to be cut off by the valve 110. Furthermore, in order for the valve 110 to cut off the pipe 1*b* or 22*b* more stably, the diameter of the pipe 21*b* or 22*b* is preferably reduced in the vicinity of the opening 21 or 22. For this, the pipe 21*b* or 22*b* may have a rib 24 lying in the vicinity of the opening 21 or 22. The rib 24, as shown in the drawing, extends inward in a radial direction from an inner circumference of the pipe 21*b* or 22*b*. Moreover, the pipe 21*b* or 22*b*, as shown by a dotted line in FIG. 4A, may be a corrugated pipe or a bellows pipe. Such a pipe includes a multitude of folds 24*a* resulting in reducing the diameter like the rib 24. Hence, the valve 110 moves to be brought contact with the rib 24 or folds 24*a* to securely cut off the corresponding pipe 21*b* or 22*b*.

Specifically, the valve 110 includes a floating body 111 and a shaft part 112 extending from a bottom of the flowing body 111. The floating body 111, as shown in the drawing, is formed to have a concave surface overall. Such a concave surface is guided by the inner circumference of the pipe 21*b* or 22*b* so that the floating body 11 cuts off the pipe 21*b* or 22*b* more accurately and easily. And, the floating body 111 is preferably a semi-spherical shell having the overall concave surface to reduce its weight. The floating body 111 can be made of a Styrofoam as a light material or the floating body 111 of the semi-spherical shell can be made of plastics due to lightweight. Hence, rigidity of the floating body 111 is reinforced as well as its endurance is enhanced. Moreover, an empty space is provided in the floating body 11 of the semi-spherical sphere, whereby the floating body 111 enables to ascend with greater buoyancy from the foam. Preferably, the floating body 111 further includes a flange 111*a* extending horizontally from its edge to be stably brought contact with the pipe 21*b* or 22*b*. The shaft part 112 is guided by the guide 120 so that the valve 110 can move stably. Preferably, the shaft part 112 is provided by a hollow shaft to reduce the weight of the valve 110.

The guide 120, as shown in FIG. 5, includes a hub 121 disposed in the opening 21 or 22 and the extension pipe 21*a* or 22*a* and a rib 122 connecting the hub 121 to the opening/extension pipe 21 or 22/21*a* or 22*a*. The hub 121 hold the shaft part 112 movably and supports the floating body 111 to lie in the extension pipe 21*a* or 22*a*. The rib 122 substantially extends to inner circumferences of the opening 21 or 22 and the extension pipe 21 or 22*a* from an outer circumference of the hub 121. A portion of the rib 122, as shown in FIG. 4A and FIG. 4B, in the vicinity of the hub 121 is formed higher than that of the rest portion of the rib 122, whereby a contact length between the hub 12 and the rib 122 is elongated to securely connect the rib 122 to the hub 121.

Meanwhile, the valve 110 may ascend by airflow via the opening 21 or 22 as well as the foam. For instance, if the door 11 of the washing machine 11 is closed too fast, such a movement of the door 11 accelerates the movement of the air in the tub 20 and drum 30 via the pipes 21*b* and 22*b*. Yet, as the pipes 2*b* and 22*b* are cut off to make the tub 20 and drum 30 airtight, the space in the tub 20 and drum 30 is pressurized so that the door 11 is pushed back not to be closed. Hence, a plate member 130, as shown in FIG. 6A to FIG. 7B, is preferably installed under the valve 110 so as not to be affected by the airflow.

Figure 7A:
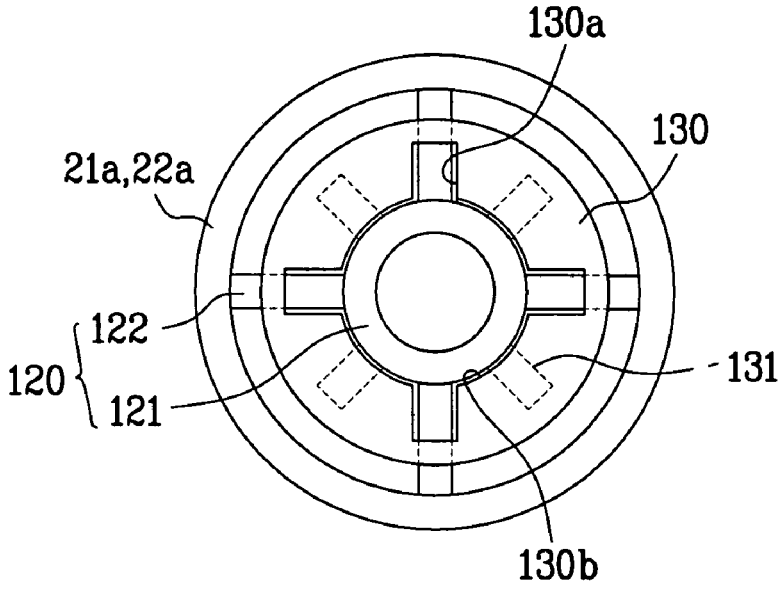
FIG. 7A and FIG. 7B are layouts of the modifications of the valve assembly in FIG. 6A and FIG. 6B, respectively.
Figure 7B:
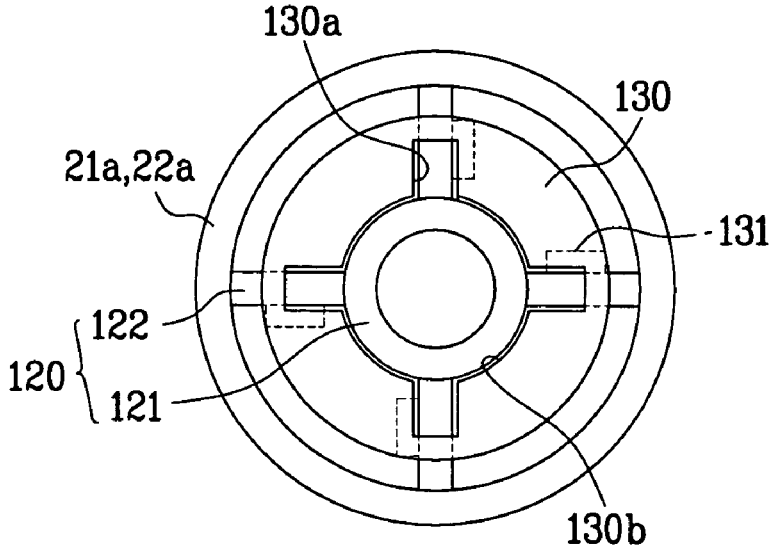

The plate member 130 cuts off the opening 21 or 22 and the extension pipe 21*a* or 22*a* so that the airflow fails to reach the valve 110 directly. Yet, since the plate member 130 partially cuts off the opening 21 or 22 and the extension pipe 21*a* or 22*a*, the water supply via the inlet opening 21 and the airflow via the ventilation opening 22 are smoothly performed. The plate member 130, as shown in FIG. 7A and FIG. 7B, is preferably a disc type matched to a shape of the valve 110 approximately. Moreover, in order to cut off abrupt airflow and to detour the airflow from the valve 110, a size of the disc member 130 is preferably equal to or greater than that of a bottom of the confronting valve 110.

Figure 6A:
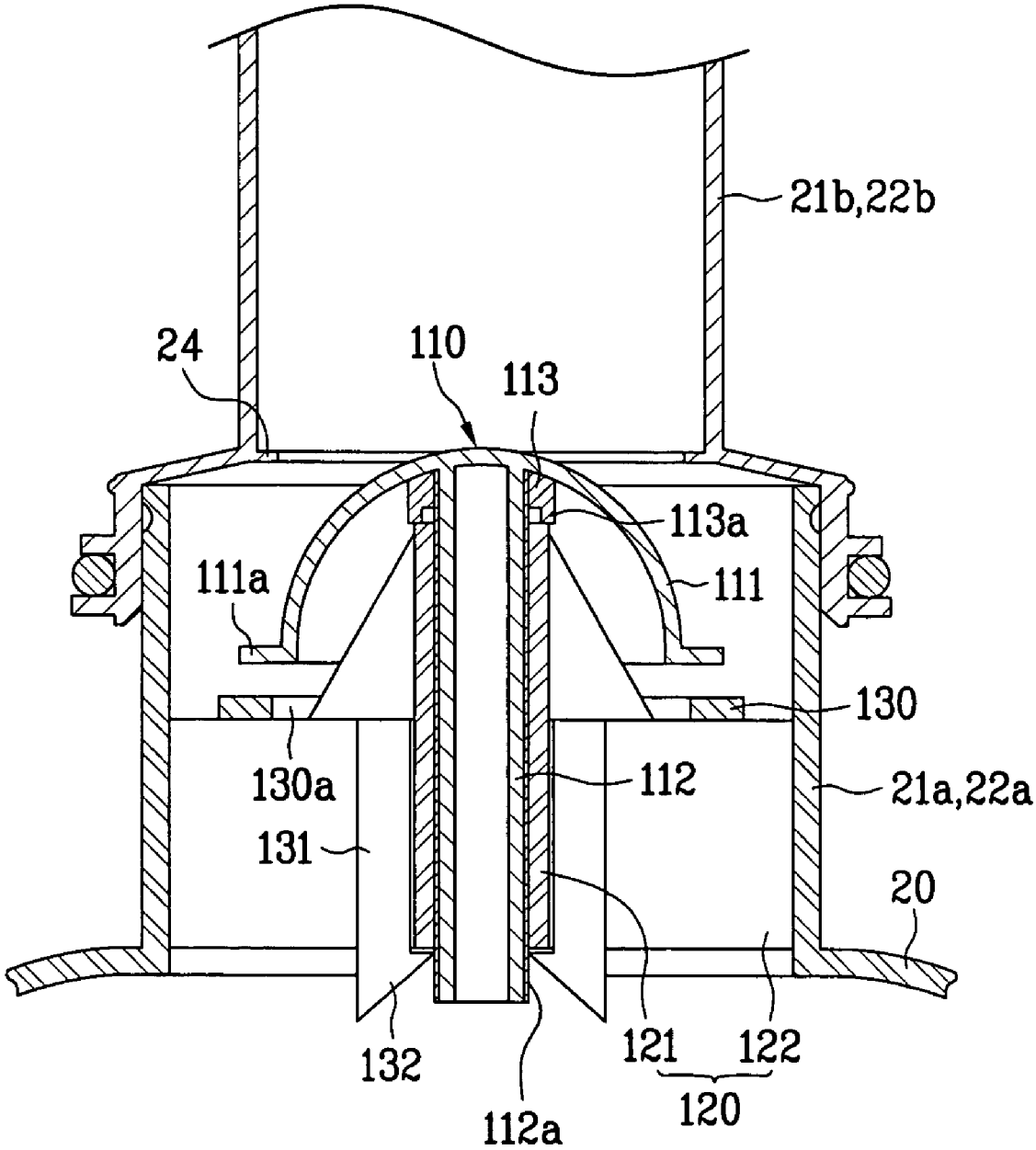
FIG. 6A and FIG. 6B are cross-sectional views of modifications of a valve assembly of a washing machine according to the present invention.
Figure 6B:
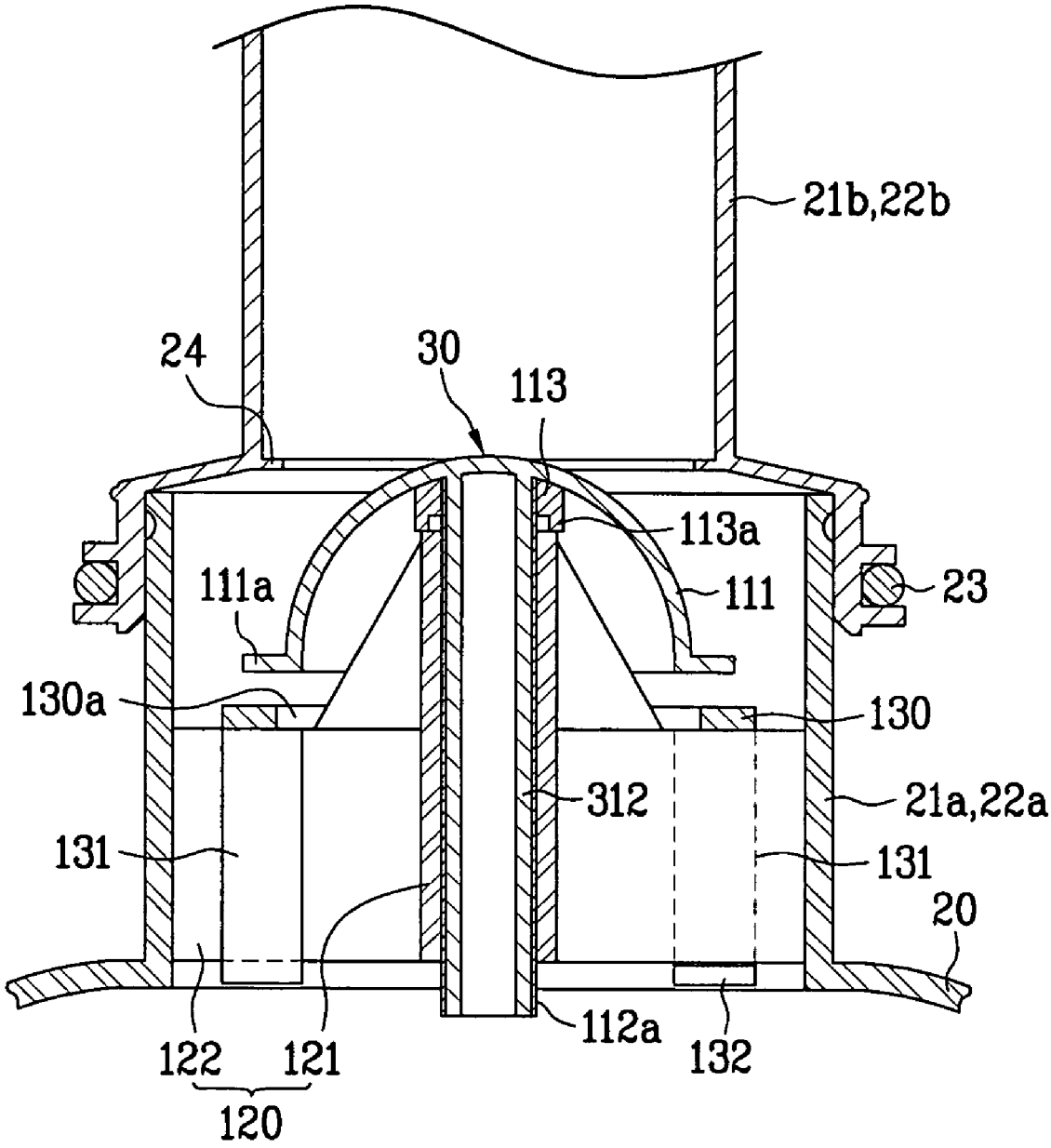

The plate member 130 is mounted on the rub 122. For this, the rib 122 in the vicinity of the inner circumferences of the opening 21 or 22 and the extension pipe 21*a* or 22*a* has a predetermined length. The plate member 130, as shown in FIG. 7A and FIG. 7B, includes a penetration hole 130*b* for the hub 121 to be mounted on the rib 122 and a plurality of slots 130*a* for the long rib 123 in the vicinity of the hub 121. Moreover, the plate member 130 further includes a leg 131 extending from a bottom of the plate member 130 and a hook 132 formed at a tip of the leg 131. The leg 131, as shown in FIG. 6A and FIG. 7A, extends to leave a predetermined distance from the rib 122 and is supported by the outer circumference of the hub 121 not to shake the plate member 130. Moreover, the hook 132 is caught on a lower tip of the hub 121 to fix the plate member 130 to the hub 121. Besides, the leg 131, as shown in FIG. 6B and FIG. 7B, extends in parallel with the rib 122 to be supported by the rib 122 so hat the plate member 130 is not moved. Moreover, the hook 132 is caught on the lower tip of the rib 122 to fix the plate member 130 to the rib 122.

The valve 110 may further include a first elastic member 113 provided on an outer circumference of the shaft part 112. The first elastic member 113 substantially has a hook shape and is installed to be brought contact with an inside of the floating body 111. When the valve 110 descends, the first elastic member 113 is inserted between a top of the hub 121 and the inside of the floating body 111. Hence, the first elastic member 113 supports the valve 110 to prevent shock and noise. Preferably, a protrusion 113*a* is further formed at a lower end of the first elastic member 113. The protrusion 13*a* is instantly deformed to effectively prevent the shock and noise the moment being contacted with the top of the hub 121. Besides, a second elastic member 112*a* may be further provided to the outer circumference of the shaft part 112. The second elastic member 112*a* is substantially formed of a layer covering the corresponding outer circumference. The second elastic member 112*a* absorbs the shock between the hub 121 and the shaft part 112 to remarkably reduce the noise while the valve 110 moves. Preferably, the second elastic member 112*a* can be built in one body of the first elastic member 113 to absorb the shock more effectively.

Figure 8A:
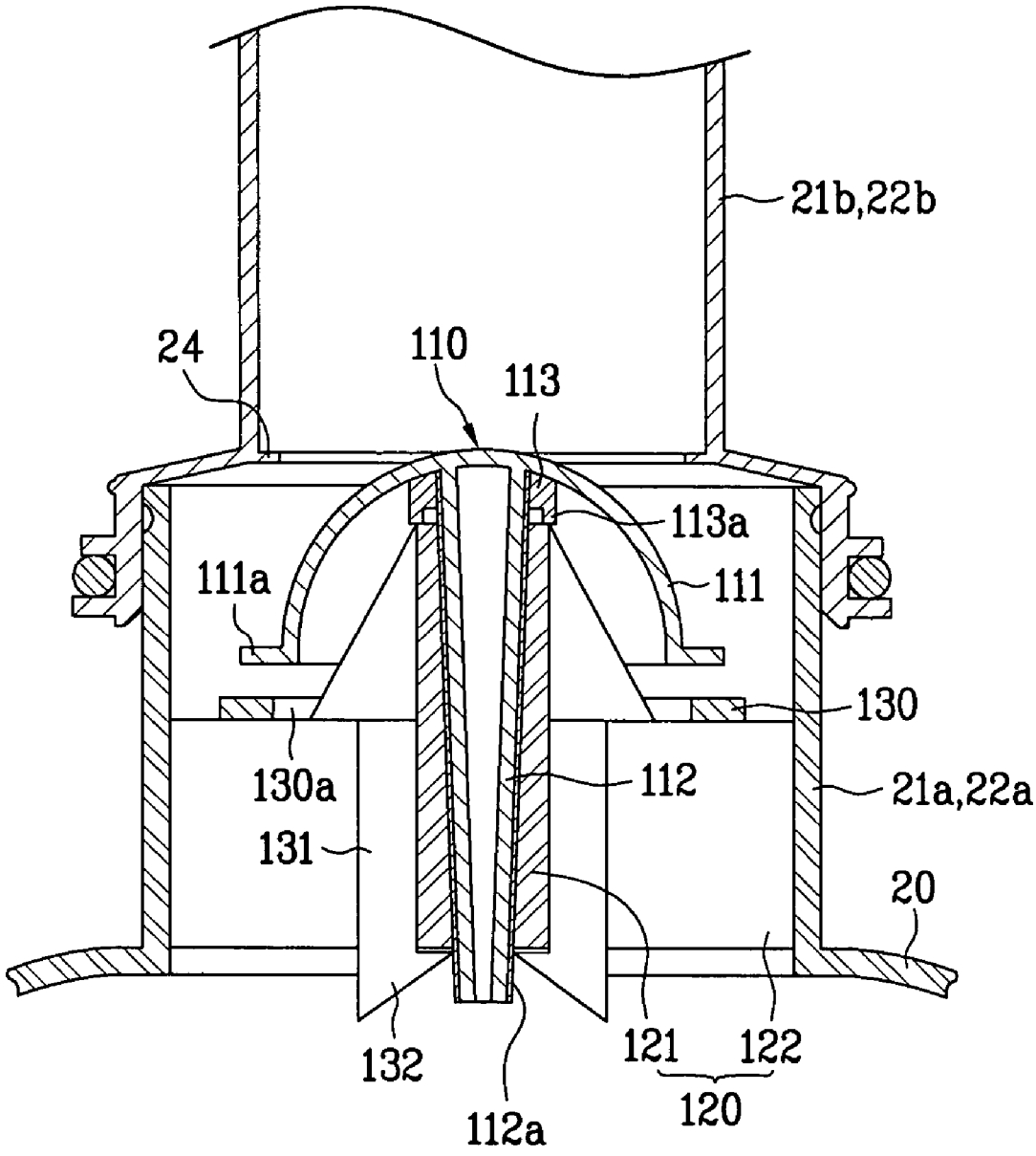
FIG. 8A and FIG. 8B are cross-sectional views of another modifications of a valve assembly of a washing machine according to the present invention.
Figure 8B:
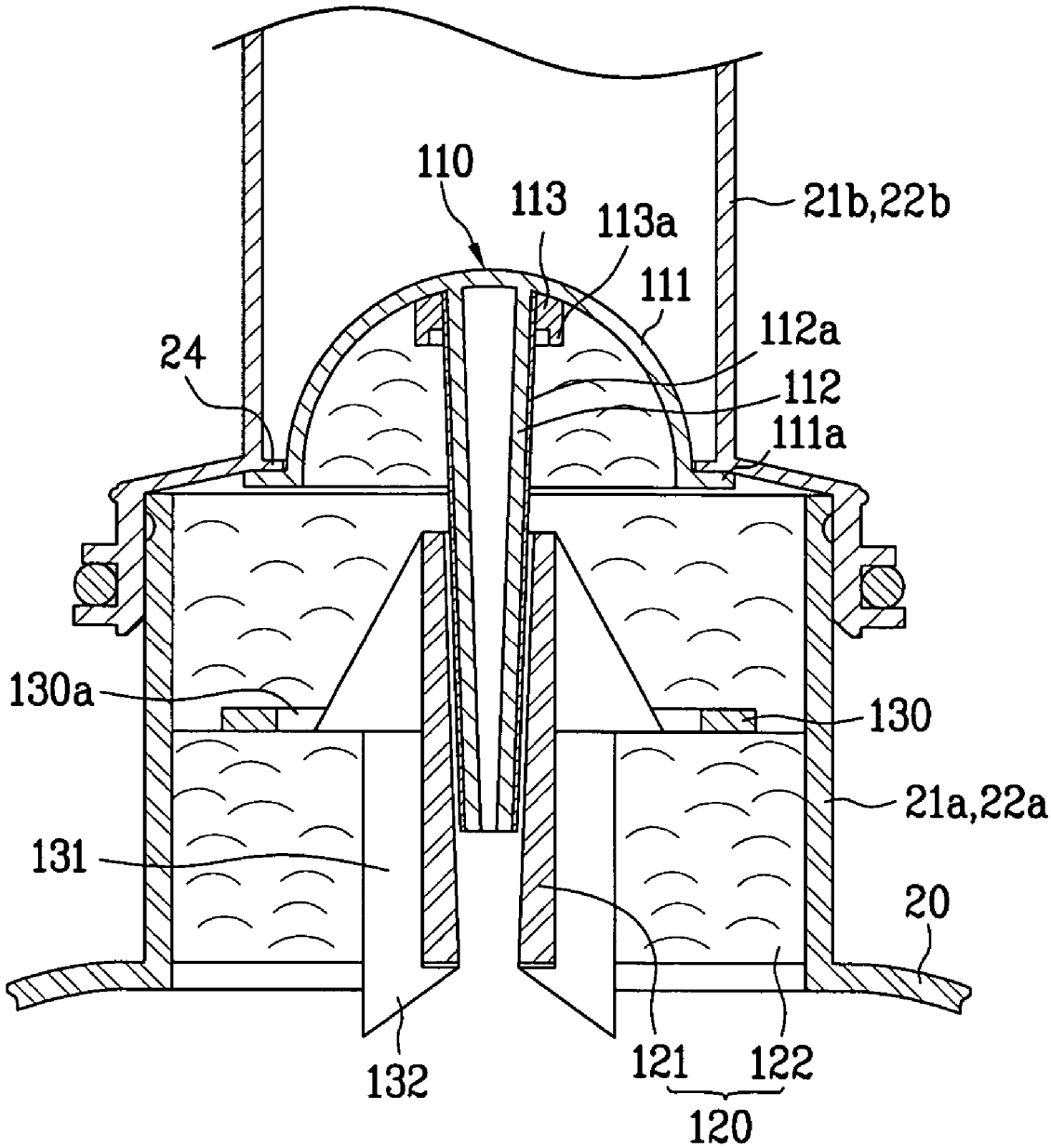

Meanwhile, a frictional force between the hub 121 and the shaft part 112 is substantially increased due to the second elastic member 112*a*, whereby the valve may fail to move smoothly. Hence, in order to reduce such a frictional force, the inner circumference of the hub 121, as shown in FIG. 8A and FIG. 8B, us preferably tapered by a predetermined angle. Namely, an inside diameter of the hub 121 gradually increases to be greater than an outer diameter of the shaft part 112. More preferably, in order to facilitate the valve 110 to move upward and downward, the inside diameter of the hub 121 gradually increases toward its top. In case that the inside diameter of the hub 121 increases only, a gap is generated between the inner circumference of the hub 121 and the outer circumference of the shaft part 112. Yet, the valve 110 may unnecessarily ascends by the airflow flowing in via such a gap. Preferably, the outside diameter of the shaft part 112 gradually increases to be brought contact with the inner circumference of the hub 121. In case that the inside diameter of the hub 121 increases toward its top, the outside diameter of the shaft part 112 increases toward its top as well. Hence, if an initial frictional force between the shaft part 112 and the hub 121 is just overcome, the shaft part 112 enables to ascend freely by the foam without influence of the additional frictional force.

An operation of the washing machine according to the present invention is explained in detail by referring to the attached drawings as follows.

First of all, the laundry is put in the drum 30 via the door 11. A user then directs washing using the control panel 12. In accordance with such a user's direction, the water is supplied to the tub 20 together with the detergent via the inlet pipe 21*b*, detergent box 21*c*, and inlet opening 21 from the external water supply source. In this case, the valve 110 is put on the hub 121 and the water and detergent flow between the valve 110 and the inlet pipe/extension pipe 21/21*a* to be supplied to the tub 30. Similarly, in case that the child may enter the drum 30 of the washing machine, the air flowing in the ventilation pipe 21*b* can be supplied to the tub 20 and the drum 30 through the gap between the valve 110 and the ventilation opening/extension pipe 22/22*b*. The water and detergent stored in the tub 30 flows in the drum 30 via the perforated holes 30*a* to be absorbed in the laundry.

After completion of the water supply for a predetermined time, the drum 30 is rotated by the driving unit 40 to initiate washing. The rotation of the drum 30 mixes the detergent, water and laundry with each other to produce the foam due to the detergent. In such a washing step, the foam keeps being produced to fill the tub 30 as well as the drum 20. And, the foam keeps filing up the extension pipes 21*a* and 22*a* via the openings 21 and 22, whereby the valve 110 ascends by the foam.

Specifically, the floating body 11 of the valve receives the buoyancy to ascend and the shaft part 112 is guided by the hub 121 of the guide. The floating body 11 of the valve keeps ascending to cut off the pipes 21*b* and 22*b*. Hence, the foam is cut off to be prevented from leaking outside along the pipes 21*b* and 22*b*. While the openings 21 and 22 and the extension pipes 21*a* and 22*a* are filled up with the foam, the valve 110 keeps cutting off the pipes 21*b* and 22*b* so as to prevent the foam from leaking.

After a predetermined time passes, the foam gradually diminishes so that the weight of the valve 110 overcomes the buoyancy to make the valve 110 descend. The shaft part 112, as shown in FIG. 4A and FIG. 8A, is guided again by the hub 121 so that the floating body 111 lands at the top of the hub 121. Hence, the pipes 21*b* and 22*b* are opened to allow the water and external air to flow in smoothly.

As explained in the foregoing description, each valve assembly 100 cuts off the corresponding pipe 21*b* or 22*b* whenever the drum 20 and the tub 30 are filled up with the foam, and opens the corresponding pipe 21*b* or 22*b* whenever the foam is removed. Namely, the valve assembly 100 selectively cuts off the pipe 21*b* or 22*b* to prevent the foam from leaking.

Accordingly, the present invention has the following advantages or effects.

First of all, the washing machine of the present invention is equipped with the valve assembly for cutting off the pipe(s) connected to the tub, thereby preventing the foam from leaking outside. Hence, the washing machine according to the present invention avoids the contamination by the leaking foam.

Moreover, a separate detergent differing in a foam amount should be used according to a type (front or top loading) of the washing machine. Yet, the present invention cuts off the foam not to leak outside, whereby a certain detergent producing massive foam can be applicable to the washing machine regardless of the type. Namely, the washing machine according to the present invention utilizes detergents regardless of their amounts of the produced foam. Therefore, it is unnecessary for the user to select the detergent appropriate for the type of the washing machine, whereby the washing machine according to the present invention provides the user with substantial convenience.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine comprising:

a housing;

a tub installed in the housing to store water, the tub having at least one opening and at least one pipe connected to the at least one opening;

a drum rotatably installed in the tub to hold a laundry therein for washing; and a valve assembly installed at the opening to selectively cut off the at least one pipe to prevent foam produced in the drum and the tub from leaking outside via the opening, wherein the valve assembly comprises a valve installed in the opening to float in an untethered manner on the foam.

2. The washing machine as claimed in claim 1, wherein the at least one opening and the at least one pipe are an inlet opening for supplying the water to the tub from an external water supply source and an inlet pipe connected to the inlet opening, respectively.

3. The washing machine as claimed in claim 1, wherein the at least one opening and the at least one pipe are a ventilation opening for allowing an external air to flow in the tub and a ventilation pipe connected to the ventilation opening, respectively.

4. The washing machine as claimed in claim 1, wherein the valve assembly further comprises a guide formed in the opening to guide a movement of the valve.

5. The washing machine as claimed in claim 1, further comprising an extension pipe connected to the at least one pipe, and wherein the valve assembly is formed at the opening to be installed in the extension pipe connected to the at least one pipe.

6. The washing machine as claimed in claim 1, wherein a diameter of the valve is smaller than a diameter of the opening and is greater than a diameter of the pipe.

7. The washing machine as claimed in claim 1, wherein the pipe has a pipe diameter partially reduced in the vicinity of the opening to be stably cut off by the valve assembly.

8. The washing machine as claimed in claim 1, wherein the pipe comprises a rib extending inward from an inner circumference.

9. The washing machine as claimed in claim 1, wherein the pipe is a corrugated or bellows pipe having a multitude of folds.

10. The washing machine as claimed in claim 4, wherein the valve comprises a floating body having a concave surface.

11. The washing machine as claimed in claim 4, wherein the valve comprises a shaft part extending from a bottom of the floating body to be guided by the guide.

12. The washing machine as claimed in claim 10, wherein the floating body is a semi-spherical shell.

13. The washing machine as claimed in claim 10, wherein the floating body further comprises a flange horizontally extending from the floating body.

14. The washing machine as claimed in claim 11, wherein the shaft part is a hollow shaft.

15. The washing machine as claimed in claim 11, the guide comprising:

a hub holding the shaft part movably to support the bottom of the floating body; and a plurality of ribs extending between an outer circumference of the hub and an inner circumference of the opening.

16. The washing machine as claimed in claim 15, wherein each of the ribs is uniform in height in the vicinity of the inner circumference of the opening but gradually increases in height in the vicinity of the outer circumference of the hub.

17. A washing machine comprising:

a housing;

a tub installed in the housing to store water, the tub having at least one opening and at least one pipe connected to the at least one opening;

a drum rotatably installed in the tub to hold a laundry therein for washing; and a valve assembly installed at the opening to selectively cut off the at least one pipe to prevent foam produced in the drum and the tub from leaking outside via the opening, wherein the valve comprises a shaft part extending from a bottom of the floating body to be guided by a guide and, wherein the valve further comprises a first elastic member provided on an outer circumference of the shaft part to lie between the guide and the floating body.

18. The washing machine as claimed in claim 17, wherein a buffer protrusion is formed at a lower end of the first elastic member.

19. The washing machine as claimed in claim 11, wherein an outer circumference of the shaft part is covered with a second elastic member.

20. The washing machine as claimed in claim 17 or claim 19, wherein the first elastic member is built in one body of the second elastic member.

21. The washing machine as claimed in claim 15, wherein an inner circumference of the hub is tapered by a predetermined angle.

22. The washing machine as claimed in claim 15, wherein an inside diameter of the hub gradually increases.

23. The washing machine as claimed in claim 15, wherein an inside diameter of the hub gradually increases toward a top.

24. The washing machine as claimed in claim 15, wherein an outside diameter of the shaft part gradually increases to be brought contact with an inside diameter of the hub.

25. The washing machine as claimed in claim 15, wherein an outside diameter of the shaft part gradually increases toward a top.

26. The washing machine as claimed in claim 4, wherein the valve assembly further comprises a plate member installed under the valve to cut off the opening partially.

27. The washing machine as claimed in claim 26, wherein the plate member is a disc type.

28. The washing machine as claimed in claim 26, wherein a size of the plate member is equal to or greater than a cross-section of a lower end of the valve.

29. The washing machine as claimed in claim 26, the plate member comprising:

at least one leg extending vertically from a bottom; and a hook provided at a tip of the leg to be caught on a portion of the guide.

* * * * *